United States Patent [19]

Miller

[11] 3,974,965

[45] Aug. 17, 1976

[54] METHOD AND APPLICATOR FOR PRODUCING CLEANING FOAM

[75] Inventor: Galen R. Miller, Tallmadge, Ohio

[73] Assignee: Chemidyne Corporation, Macedonia, Ohio

[22] Filed: July 17, 1974

[21] Appl. No.: 489,092

[52] U.S. Cl. ..... 239/413; 239/427; 239/432

[51] Int. Cl.[2] ..... B05B 7/00

[58] Field of Search ..... 239/413, 343, 417.5, 239/427, 427.3, 432, 530; 169/14, 15

[56] References Cited

UNITED STATES PATENTS

| | | | |
|---|---|---|---|
| 2,358,386 | 9/1944 | Doll | 239/432 X |
| 2,511,420 | 6/1950 | Thompson | 239/343 |
| 2,887,275 | 5/1959 | Dixon, Jr. et al. | 239/427 |
| 2,931,580 | 4/1960 | Johnson | 239/417.5 X |
| 3,199,790 | 8/1965 | Giesemann | 239/432 X |
| 3,604,630 | 9/1971 | Conti | 239/432 X |
| 3,784,111 | 1/1974 | Piggott | 239/432 |

*Primary Examiner*—John J. Love
*Attorney, Agent, or Firm*—Fay & Sharpe

[57] ABSTRACT

A method and applicator is disclosed for producing cleaning foam. The applicator includes a housing which defines a diffusion chamber having an inlet and an outlet end. First and second inlets are peripherally located in the housing adjacent its inlet end and are in fluid communication with the diffusion chamber. These first and second inlets include flow regulators or valves for individually adjusting the rate of flow of pressurized cleaning liquid and pressurized air are continuously introduced therethrough during operation into the diffusion chamber. Upon passing through the inlets, the pressurized liquid and air flow through a diffusion means which is contained within the diffusion chamber. As the liquid and air pass through the diffusion means, the air is mixed with and entrained in the liquid and foaming occurs. Subsequently, the foam passes into a reduction chamber disposed adjacent the outlet end of the applicator. The reduction chamber has an inwardly tapering passageway so that as the foam passes therethrough, its velocity is increased due to the affect of the taper to provide a propelling force. After exiting the reducton chamber, the foam is continuously directed outwardly of the applicator through a nozzle toward those items to be cleaned.

7 Claims, 5 Drawing Figures

FIG. 4
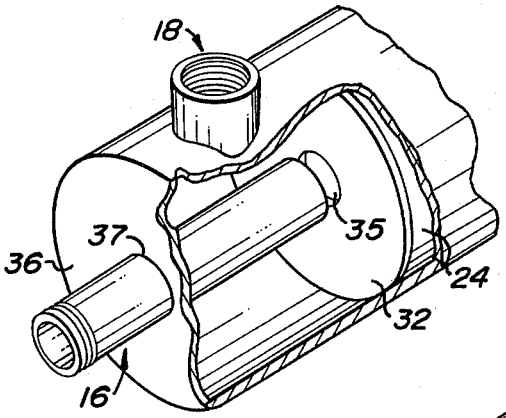
FIG. 2
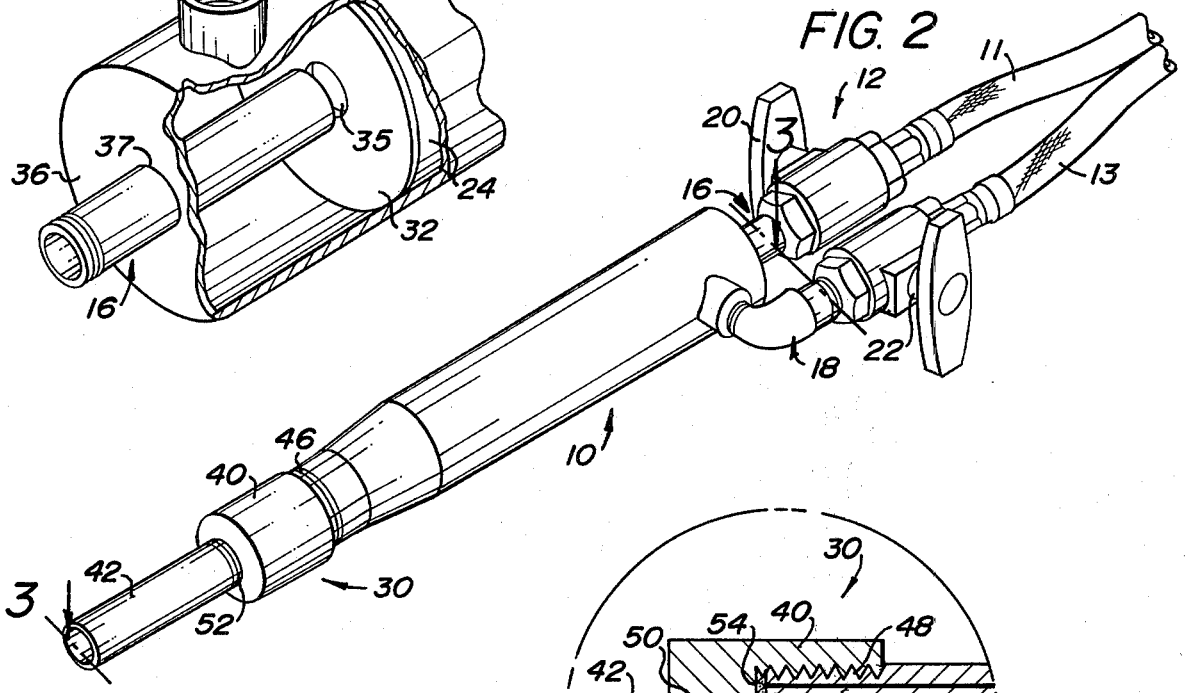
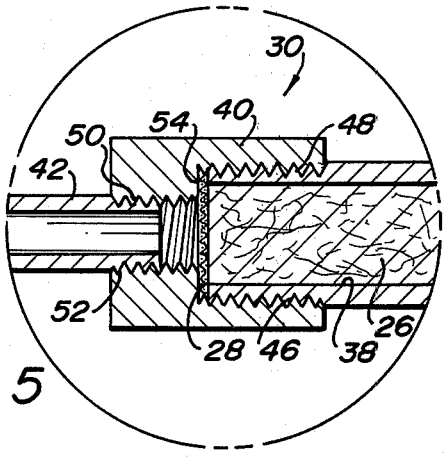
FIG. 5
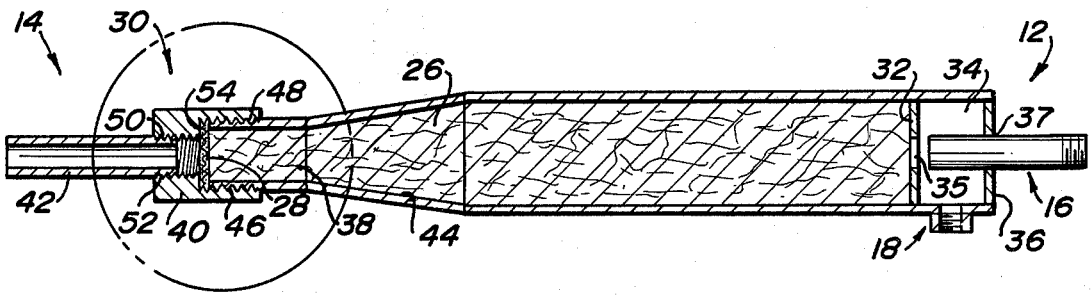
FIG. 3

METHOD AND APPLICATOR FOR PRODUCING CLEANING FOAM

BACKGROUND OF THE INVENTION

This invention is directed toward the art of producing and applying cleaning foam. More particularly, the invention relates to an improved method and applicator for producing cleaning foam to be used to clean the inside of food processing plants, although it will be appreciated that the invention has other applications in other environments where it is desired to continuously generate a foam or like substance.

Applicators for directing the spray of cleaning foam are extensively used in food processing plants to clean the dirt, dust and food residue, such as food protein, animal fat and animal blood generated by the everyday operations of such plants. Although such applications are known, the subject invention provides a new method and application which have several distinct advantages, in both structure and operation, not found in prior applicators.

One advantage is that of convenience. In the past, applicators have not included flow regulators which permitted the adjustment of pressurized cleaning liquid and pressurized air at the applicator itself. Instead, such controls were located either at the tank of pressurized cleaning liquid or at some location between the tank and the applicator. Consequently, when it became necessary to change the rate of flow of either the pressurized cleaning liquid or air, the operator would have to return to the tank to make such adjustments. In view of the fact that quite often the cleaning process takes place at distances of up to 50 feet from the cleaning liquid tank, the requirement of having to go back to the cleaning tank to make the adjustments was both time consuming and wasteful in terms of cleaning foam. The return trip to the cleaning tank also distributed foam along the way on items where it was neither needed nor desired.

The subject invention, however, alleviates this problem since the flow regulators are located at the applicator itself. Thus, when the operator must change the flow of either the pressurized cleaning liquid or the pressurized air, he is not required to return to the cleaning liquid tank but rather, may conveniently and easily make such adjustments while continuing the cleaning process. Such provision assures that no time or cleaning foam is unnecessarily wasted.

Further, once the cleaning process has been completed and the operator wishes to turn off the flow of cleaning foam, he can do so at the applicator. With prior applicators, this was often not possible so that it was necessary for the operator to return to the cleaning liquid tank for this purpose. As such, again, considerable amounts of cleaning foam were wasted during the time required to make the trip from the cleaning area back to the tank.

Finally, the occasion often arises wherein the operator has finished cleaning a specific area and wishes to shut off the flow of cleaning foam temporarily so that he may move to a new area and resume cleaning. Once again, substantial time and material savings can be realized when using the subject invention by having the capabilities of shutting off the flow of foam at the applicator during that time when the applicator is not being used.

Another advantage of the subject invention is found in the diffusion means used to produce the cleaning foam from the mixture of pressurized cleaning liquid and pressurized air. It has been discovered that the preferred diffusion means, that is, a stainless steel, plastic or other acceptable media which visually resembles a conventional household or kitchen cleaning pad, has superior foam producing qualities which do not exist in prior applicators. Prior applicators of this general type such as those shown in U.S. Pat. Nos. 3,191,790 and 2,864,714, have used diffusion means comprised of glass or ceramic beads. While such beads have provided adequate results, use of a stainless steel, plastic or other type of interwoven diffusing media in the subject method and applicator has been found to produce superior results.

BRIEF DESCRIPTION OF THE INVENTION

In accordance with the present invention, there is provided an applicator for combining regulated quantities of pressurized cleaning liquid and pressurized air to produce a cleaning foam. The applicator includes an elongated housing having an inlet end, an outlet end and defining a diffusion chamber therein in fluid communication with the inlet end. First and second inlets are disposed adjacent the inlet end for individually supplying pressurized cleaning fluid and air to the applicator, and these inlets include first and second flow regulators, respectively, associated therewith for controlling liquid and air flow to the applicator. A diffusion means is secured in between the inlet and outlet ends to promote foaming of the liquid and air as they pass therethrough, and a distribution means is disposed adjacent the applicator outlet end for directing the spray of foam generated within the applicator outwardly thereof.

In accordance with another aspect of the present invention, means are included for retaining the diffusion means in the housing and a baffle disposed in the housing adjacent the inlet end separate the mixing and diffusion chambers while allowing fluid communication therebetween.

In accordance with another aspect of the present invention, the applicator further includes a tapered reduction chamber disposed between the diffusion chamber and the distribution means to increase the velocity of foam flow for propelling it outwardly of the applicator.

In accordance with still another aspect of the present invention, the diffusion means is comprised of thin, wire-like interwoven strands of stainless steel, plastic or other suitable material.

In accordance with yet another aspect of the present invention, a process for cleaning is provided which comprises the steps of:

a. supplying cleaning liquid and air separately and under pressure to an applicator;

b. adjusting the rate of flow of the liquid and air at the applicator to obtain the desired mixture thereof for cleaning purposes;

c. passing the mixture through a diffusion means disposed in the applicator to cause mixture foaming; and d. discharging the foam from the applicator outlet end at a velocity sufficient to propel it onto items to be cleaned.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof and wherein:

FIG. 2 is a perspective view of the applicator which is the focus of the subject invention;

FIG. 3 is a cross-sectional view of the applicator taken on lines 2—2 of FIG. 2;

FIG. 4 is an enlarged partial view of the inlet end of the subject applicator; and FIG. 5 is an enlarged view of the distribution passageway encircled in FIG. 3.

DESCRIPTION OF THE PREFERRED EMBODIMENT

Figure 1:
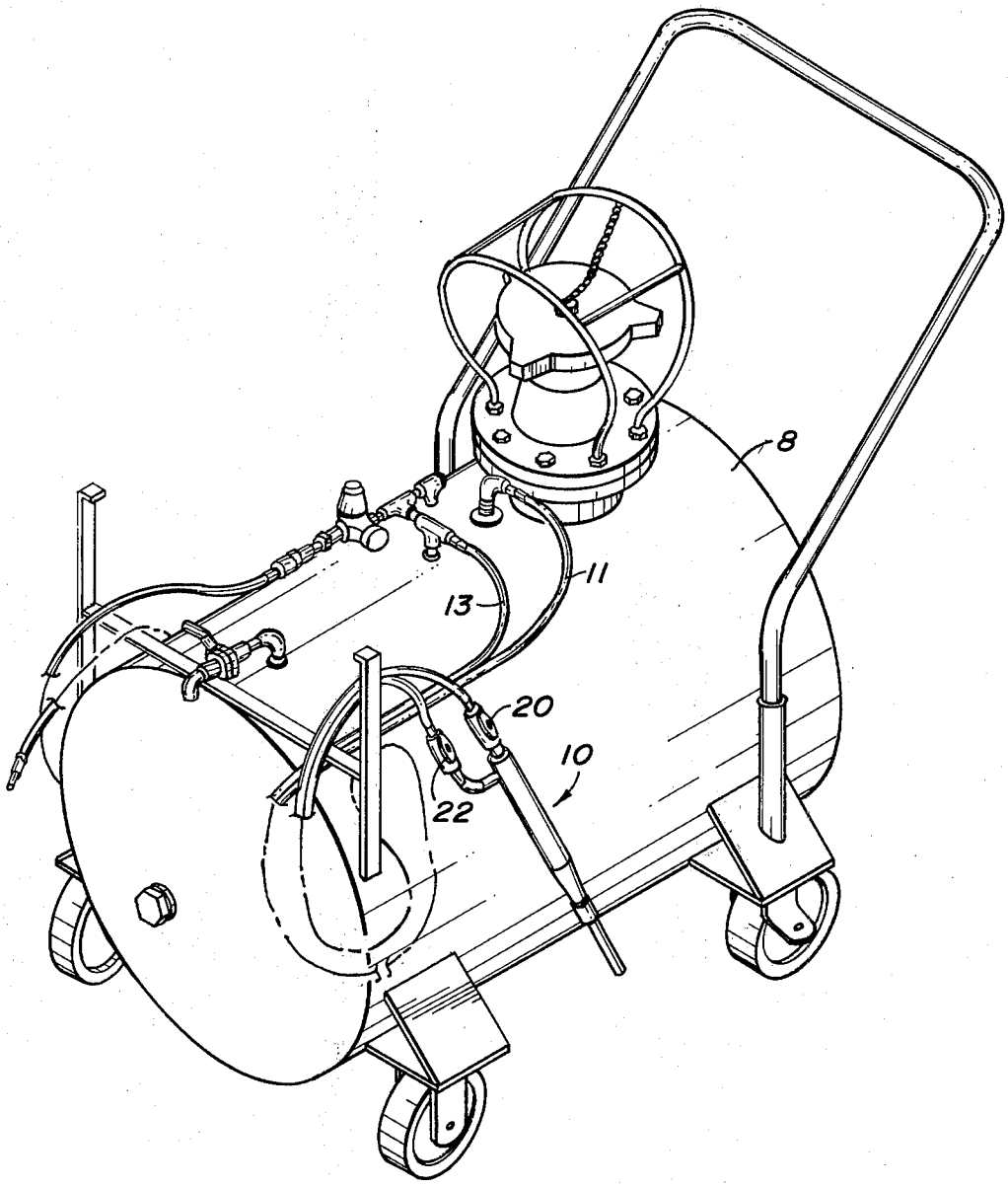
FIG. 1 is a perspective view of a pressurizable cleaning liquid tank including the associated applicator attached thereto.

Referring more particularly to the drawings wherein the showings are for the purpose of illustrating the preferred embodiment of the invention only and not for limiting same, FIG. 1 illustrates the overall arrangement of a pressurizable cleaning liquid tank 8 and an applicator 10 operatively attached thereto by means of a pressurizable air hose 13 and a pressurizable cleaning liquid hose 11.

In general, as best shown in FIGS. 2 and 3, applicator 10 comprises an elongated housing having an inlet end 12 and an outlet end 14. In the preferred embodiment of the subject invention, inlet end 12 is shown as including a first inlet 16 and a second inlet 18. First inlet 16 is adapted to provide a supply of pressurized cleaning liquid to applicator 10 from tank 8 by way of hose 11 while second inlet 18 is adapted to provide a supply of pressurized air either from the air above the liquid in the tank or from a conventional, continuous source (not shown) to applicator 10 by way of hose 13. While inlets 16 and 18 are shown as including portions of pipe welded to corresponding orifices in applicator 10, it will be appreciated that a number of suitable means for providing these inlets could be employed without departing from the intent and scope of the invention.

Of particular significance to the subject invention is that inlets 16 and 18, respectively, include a first flow regulator 20 and a second flow regulator 22 adjacent thereto. These regulators may be of a type adapted for use in the environment contemplated for the preferred embodiment of the invention. Conventional ball-type valves have been found to be adequate although other valve types could also be used.

The importance of the flow regulators 20 and 22 is not only in the fact that they can be adjusted to vary the rates of flow of liquid and air to achieve a proper mixture for developing the texture of foam desired, but more importantly, in the fact that the means for adjusting the mixture can be accomplished at the applicator itself. As a result of using the subject invention and as it becomes necessary for the operator to vary the mixture due to his encountering a particularly dirty area to be cleaned, he can make the required adjustments while he continues to work and he need not return to the cleaning liquid tank to make the required changes as has been the case with prior applicators.

In addition, flow regulators 20 and 22 can be operated so as to completely shut off the flows of liquid and air. The fact that these flows may be shut off at the applicator is also deemed to be an important advantage of the subject invention since it facilitates temporarily halting the cleaning process while the operator moves from one area to another. As such, the cleaning foam is not wasted and inadvertently sprayed onto areas which do not require cleaning. Similarly, once the operator has finished with the cleaning process, he can shut off the flow of foam as he returns to the cleaning liquid tank. Consequently, foam is not wasted as the operator returns to the cleaning tank from distances of approximately 50 or 100 feet or distributed on items where it is not desired.

As best shown in FIGS. 2, 3 and 4, applicator 10 is preferably generally cylindrically shaped and defines a housing having an end plate 36 disposed at inlet end 12. Included in this end plate is a generally centrally located passageway 37 adapted to receive inlet 16 in a fluid-tight relationship. In a similar manner, inlet 18 is peripherally located in applicator 10 adjacent inlet end 12 and, like inlet 16, the juncture of inlet 18 and the applicator is fluid-tight.

Located within applicator 10 and spaced from end plate 36 toward outlet 14 is a baffle 32. Although the spacing of baffle 32 along applicator 10 may vary, in the preferred embodiment of the invention here under discussion, the area between end plate 36 and the baffle defines a mixing chamber 34. The innermost ends of inlets 16 and 18 open into this chamber for initial mixing of the pressurized cleaning liquid and air passing therethrough. Baffle 32 includes a generally centrally located passageway 35 therethrough to facilitate passage of this mixture on through the applicator for eventual dispensing as will be described hereinafter. Of course, other arrangements could also be used in permitting flow through baffle 32 without departing from the concepts of the present invention. Likewise, it has also been found that satisfactory results could be obtained when baffle 32 is entirely eliminated from the applicator.

In the preferred arrangement for the subject invention, inlet 18 is peripherally located in applicator 10 and is shown as being disposed generally perpendicular to the applicator sidewall. Further, inlet 16 is shown as being centrally located in the end plate 36 generally coaxial with the applicator's longitudinal axis. Passageway 35 in baffle 32 is similarly axially aligned relative to the inlet 16 and the applicator. As a result of this structure, the pressurized cleaning liquid introduced into applicator 10 through inlet 16 has a generally straight-line path through mixing chamber 34 and through passageway 35 of baffle 32. Pressurized air introduced into the applicator through inlet 18 does not usually travel through a straight-line path as it enters mixing chamber 34, although operation is possible in this manner. Rather, the air enters the chamber in a direction normal to the direction of exit.

The particular configuration for mixing chamber 34 described herein has been found to function well but other arrangements are possible. More specifically, the effect created by the configuration of mixing chamber 34 acts to mix the liquid cleaner and the air continuously supplied thereto without causing premature foaming. Thus, the liquid cleaner and air are first thoroughly mixed which results in eventual optimum foaming as will become apparent hereinafter. While this particular mixing chamber is advantageous, it could be varied or eliminated without deviating from this invention.

Disposed adjacent mixing chamber 34 in the applicator at baffle 32 is an elongated diffusion chamber 24. This diffusion chamber is placed in fluid communication with the mixing chamber by way of passageway 35 in baffle 32. As to be discussed in greater detail herein, diffusion chamber 24 functions to provide an area in which foaming of the liquid cleaner and air mixture takes place. At the other or outlet end of the diffusion chamber from baffle 32, there is provided a reduction chamber 44. This reduction chamber is in fluid communication with the diffusion chamber and essentially functions to increase the velocity of foam passing therethrough in order to propel it outwardly of applicator outlet end 14 and onto the items to be cleaned.

More specifically, as best shown in FIGS. 2 and 3, reduction chamber 44 includes a tapering passageway therethrough. With this structure, the inlet area of the reduction chamber is substantially the same size and the outlet area of diffusion chamber 24 while the oulet area or orifice of the reduction chamber is smaller than its corresponding inlet area.

With reference to FIGS. 3 and 4, disposed adjacent reduction chamber 44, and in fluid communication therewith, is a distribution means 30 which essentially functions to direct the continuous flow of foam from applicator outlet end 14. In the preferred embodiment, distribution means 30 defines a distribution chamber 38 located adjacent reduction chamber 44 and in fluid communication therewith. The distribution means has external threads 46 located at its outlet orifice to threadedly receive a coupling 40 which has corresponding internal threads 48 thereon.

Coupling 40 functions to provide a method and means by which a nozzle 42 may be interchanged with other nozzles should the operator desire to change the type of foam spray produced in order to meet a particular cleaning problem. For this purpose, coupling 40 also includes internal threads 50 adjacent its outlet end to receive nozzle 42 by external threads 52 thereon as well as any other nozzle type which may be desired having similar external threads corresponding to threads 52.

Another aspect of the subject invention which is of particular importance in providing quality cleaning foam is the diffusion means generally designated 26 which is secured in diffusion chamber 24. It is contemplated that this diffusion means material will substantially completely fill diffusion, reduction and distribution chambers 24, 44 and 38, respectively, although less diffusion means will suffice. This diffusion means is of importance since it operates to cause the pressurized mixture of cleaning liquid and air to foam as it is forced therethrough. In the preferred arrangement, diffusion means 26 is comprised of thin, wire-like strands of stainless steel, plastic or other suitable material which can withstand the severe environment. The strands are interwoven in such a manner that the diffusion means 26 visually resembles a conventional household or kitchen cleaning pad of the general type, for example, marketed by the Kurly Kate Corporation under the KURLY KATE trademark or ACS Industries, Inc. under the SCRUBBLE trademark. Thus, as the pressurized mixture of liquid cleaner and air leaves the mixing chamber 34, enters the diffusion chamber and is forced through the diffusion means, the liquid cleaner and air mixture further interact with each other such that the air becomes entrained in the liquid cleaner to produce the cleaning foam.

The particular structure of diffusion means 26 has importance since it has been found that the particular structure above described provides an atmosphere for developing foam having superior qualities when compared to that generated by prior applicators. Typically, past applicators have used diffusion means comprised of glass or ceramic beads and, while such beads have provided adequate results, the use of the interwoven plastic or stainless steel wire-like strands yields far superior foam producing results.

Finally, the preferred embodiment of the present invention includes a retaining means 28 which functions to retain diffusion means 26 in position within diffusion chamber 24. Although retaining means 28 is not deemed to be an essential requirement to the operation of the applicator, it has been found that because the liquid cleaner and air are commonly under pressures of 50 to 100 psi, the diffusion means 26 has a tendency to be individually expelled from the outlet end 14 of the applicator. If necessary to prevent expulsion, retaining means 28 is included and comprises a stainless steel, wire-mesh screen member which is substantially the same size and the size of the outlet area of the distribution means 30 and is positioned between the outlet orifice of distribution chamber 38 and coupling 40 such that when the coupling is threaded onto the distribution means, a shoulder 54 holds the retaining means in place. Various means for securing the diffusion means are possible and could include the properties of the diffusion means itself, the shape of the chamber in which it is located, hooks, abutments or numerous other possibilities.

Operation

In operation of the subject invention, cleaning liquid is supplied under pressure to the inlet end of applicator 10 through hose 11. Typically, the source of cleaning liquid comprises a pressurizable tank or a central tank and pump containing such liquid. In a similar manner, pressurized air from a conventional separate source or air within the tank is supplied to the applicator inlet end through hose 13. It is contemplated that in practicing the subject invention, the cleaning liquid and air will be supplied to the applicator under pressures in the range of 50 to 200 psi although much higher pressures of about 700 psi could be used if proper equipment were utilized.

In order that the rates of flow of the pressurized cleaning liquid and the pressurized air may be controlled, flow regulators 20 and 22 in the preferred form of ball valves are located at the inlet end of the applicator. Consequently, the operator may individually vary the rates of flow of the cleaning liquid and air such that a proper mixture thereof for developing the desired foam textures may be obtained.

After entering applicator 10 through the flow regulators 20 and 22, the pressurized cleaning liquid and air are directed to a mixing chamber 34 wherein the liquid and air are mixed prior to foaming. After mixing, the liquid-air mixture passes through a baffle 32 and into diffusion chamber 24 which causes the mixture to foam. The foam enters reduction chamber 44 wherein its velocity of travel is increased such that it will be propelled out of outlet end 14 of the applicator 10 and onto the items to be cleaned. At least the diffusion and reduction chambers 24 and 44, respectively, include a porous diffusion means 26 to facilitate generation of the foam.

The invention has been described with reference to the preferred embodiment. Obviously, modifications and alterations will occur to others upon the reading and understanding of this specification. It is my intention to include all such modifications and alterations insofar as they come within the scope of the appended claims or the equivalents thereof.

I now claim:

1. An applicator for combining a regulated quantity of pressurized cleaning liquid and a regulated quantity of pressurized air to produce a cleaning foam, including:

a housing having an inlet and an outlet end;

a diffusion chamber in said housing and in fluid communication with said inlet end of said housing;

a first inlet, peripherally located in said housing at said inlet end and in fluid communication with said diffusion chamber, for supplying pressurized cleaning liquid to said diffusion chamber, wherein said first inlet includes a first flow regulator;

a second inlet, peripherally located in said housing at said inlet end and in fluid communication with said diffusion chamber, for supplying pressurized air to said diffusion chamber, wherein said second inlet includes a second flow regulator;

a diffusion means secured in said housing, located between said inlet end and said outlet end, to promote foaming of the liquid and air;

a means for retaining said diffusion means within said housing;

a baffle located between said inlets and said diffusion chamber, thereby defining a mixing chamber at said inlet end of said housing, wherein said baffle includes a passageway for fluid communication between said mixing chamber and said diffusion chamber;

a distribution means, located at said outlet end of said housing, in fluid communication with said diffusion chamber, for directing the spray of foam generated within said applicator, the distribution means including a nozzle through which the cleaning foam is propelled; and a reduction chamber, located between said diffusion chamber and said distribution means, said reduction chamber having a passageway therethrough such that the inlet orifice of said reduction chamber is substantially the same size as and operatively attached to the outlet orifice of said diffusion chamber while the outlet orifice of said reduction chamber is smaller than the inlet orifice.

2. The applicator of claim 1 wherein said first and second flow regulators are adjustable valves which operate to vary the rate of fluid flow into said housing and which also operate to shut off fluid flow into said housing; and the distribution means is smaller in diameter than the housing.

3. The applicator of claim 1 which further comprises an end plate at the inlet end of said housing, wherein one of the said first inlet and second inlet is circumferentially located in said housing at said inlet and wherein the other of the said first inlet and second inlet is centrally located in said end plate and extends therethrough to within close proximity of an axially aligned passageway in said baffle.

4. The applicator of claim 1 wherein said distribution means includes:

a distribution chamber in fluid communication with said reduction chamber wherein said distribution chamber is externally threaded on its outlet end;

a coupling, internally threaded on both its inlet and outlet ends, wherein said coupling is threadedly received on said distribution chamber;

a nozzle, externally threaded on its inlet end and threadedly received in the outlet end of said coupling.

5. The applicator of claim 1 wherein the retaining means used to retain said diffusion means within said housing includes a screen located distribution means.

6. The applicator of claim 1 wherein said diffusion means is comprised of thin, interwoven strand members which collectively define a porous pad-like structure allowing fluid passage therethrough in a tortuous path.

7. An applicator for combining a regulated quantity of pressurized cleaning liquid and a regulated quantity of pressurized air to produce a cleaning foam including:

a housing having an inlet end and an outlet end;

a diffusion chamber in said housing and in fluid communication with said inlet end of said housing;

a first inlet located in said housing at said inlet end and in fluid communication with said diffusion chamber, for supplying pressurized cleaning liquid to said diffusion chamber, wherein said first inlet includes a first flow regulator;

a second inlet peripherally located in said housing at said inlet end and in fluid communication with said diffusion chamber, for supplying pressurized air to said diffusion chamber, wherein said second inlet includes a second flow regulator:

a baffle located between said inlets and said diffusion chamber, thereby defining a mixing chamber at said inlet end of said housing, wherein said baffle includes a passageway for fluid communication between said mixing chamber and said diffusion chamber;

a reduction chamber, in fluid communication with said diffusion chamber, having a tapering passageway therethrough such that the inlet orifice of said reduction chamber is substantially the same size as the outlet orifice of said diffusion chamber while the outlet orifice of said reduction chamber is smaller than the inlet orifice of said reduction chamber;

a distribution means, in fluid communication with said reduction chamber, including;

a distribution chamber in fluid communication with said reduction chamber wherein said distribution chamber is externally threaded on its outlet end;

a coupling, internally threaded on both its inlet and outlet ends, wherein said coupling is threadedly received on said distribution chamber;

a nozzle, externally threaded on its inlet end and threadedly received in the outlet end of said coupling;

a diffusion means contained in said housing, located between said baffle and said outlet end of said distribution chamber;

means for retaining said diffusion means within said housing including a screen, which is substantially the same size as the size of the outlet orifice of said distribution chamber, positioned between said distribution chamber and said bushing.

* * * * *